US005688042A

United States Patent [19]

Madadi et al.

[11] Patent Number: 5,688,042

[45] Date of Patent: Nov. 18, 1997

[54] LED LAMP

[75] Inventors: Abolfazl Madadi, Scarborough; Morteza Showleh, Markham; David J. Rycroft, Unionville, all of Canada

[73] Assignee: Lumacell, Inc., Scarborough, Canada

[21] Appl. No.: 560,440

[22] Filed: Nov. 17, 1995

[51] Int. Cl.[6] ..... F21V 3/00

[52] U.S. Cl. ..... 362/240; 362/373; 362/800; 362/812; 40/570

[58] Field of Search ..... 362/240, 249, 362/373, 800, 812; 40/564, 570, 572; 313/318.01, 318.07

[56] References Cited

U.S. PATENT DOCUMENTS

| | | | |
|---|---|---|---|
| 739,845 | 9/1903 | Evans . | |
| 849,574 | 4/1907 | Ruger . | |
| 2,175,072 | 10/1939 | Wompey . | |
| 3,089,973 | 5/1963 | Herold et al. | 313/318.01 |
| 3,931,689 | 1/1976 | Shine . | |
| 4,148,096 | 4/1979 | Haas et al. . | |
| 4,727,289 | 2/1988 | Uchida | 362/800 |
| 4,953,067 | 8/1990 | Moore | 362/812 |
| 4,965,457 | 10/1990 | Wrobel et al. | 362/249 |
| 5,006,971 | 4/1991 | Jenkins | 362/249 |
| 5,018,290 | 5/1991 | Kozek et al. | 362/812 |
| 5,103,382 | 4/1992 | Kondo et al. | 362/800 |
| 5,160,201 | 11/1992 | Wrobel | 362/249 |
| 5,220,235 | 6/1993 | Wakimizu et al. | 313/318.01 |
| 5,268,828 | 12/1993 | Miura | 362/249 |
| 5,303,124 | 4/1994 | Wrobel | 362/249 |
| 5,343,375 | 8/1994 | Gross et al. | 362/800 |
| 5,365,411 | 11/1994 | Rycroft et al. | 362/249 |
| 5,388,357 | 2/1995 | Malita | 362/812 |
| 5,410,453 | 4/1995 | Ruskouski | 362/800 |
| 5,416,679 | 5/1995 | Ruskouski et al. | 362/800 |
| 5,463,280 | 10/1995 | Johnson | 362/800 |
| 5,506,760 | 4/1996 | Giebler et al. | 362/800 |
| 5,575,459 | 11/1996 | Anderson | 362/240 |

*Primary Examiner*—Ira S. Lazarus
*Assistant Examiner*—Sara Sachie Raab
*Attorney, Agent, or Firm*—Pepe & Hazard

[57] ABSTRACT

A LED lamp for use in lighted sign assemblies has a base configured to engage an associated electrical socket, a light array extending from the base, the base has conductive elements on the outer surface thereof to effect a power connection to the socket and internal contacts coupled thereto. The light array consists of three elongated circuit boards extending from the end of the base and oriented with respect to each other to form an array of triangular cross section. Each of the circuit boards has a multiplicity of light emitting diodes mounted upon its outer surface and spaced along its length, and a conductor connected to the diodes. A power transfer circuit electrically connects the circuit board conductor to the contacts in the base to provide electrical power to the diodes, and a generally tubular housing of light transmitting material mounted upon and extending from the end of the base in spaced relationship to the array.

17 Claims, 4 Drawing Sheets

10
11
13
14
16
18
20
22
23
24
26
28
29
30
36
38
46
50

LED LAMP

BACKGROUND OF THE INVENTION

The present invention relates to lighted exit and emergency signs, and, more particularly, to LED lamps for such signs.

Exit and emergency signs are widely employed in commercial and industrial buildings, as well as in multi-unit residential buildings to identify exits and provide other information to persons who may be within the structure. Some such signs are continuously illuminated; others are illuminated only in the event of emergencies such as the loss of power; and still others are illuminated by the building power supply normally and by battery power when building power is lost. Such signs are usually illuminated by one or more incandescent or compact fluorescent lamps, each of which will normally have a rating of 15–25 watts. The use of incandescent and fluorescent lamps results in a power requirement which is particularly significant when the signs are powered by a battery supply in the event of an emergency.

There have been efforts to utilize light emitting diodes (LEDs) to effect illumination of exit and emergency signs so as to reduce the amount of the power required, and such efforts have necessarily involved the use of a relatively large number of spaced light emitting diodes to provide the necessary candlepower for adequate illumination. In some such signs, the light emitting diodes have been oriented in rows corresponding to the configuration of the letters in a stencil or lettered plate under which they are disposed. Because of this orientation, an undesirable result is that the light emitting diodes produce a multiplicity of bright spots in the illuminated legend of the sign even when diffuser material is placed between the LEDs and the legend stencil or plate.

In addition to the lower power consumption (an array may require only 2 watts), light emitting diodes generate less heat and accordingly are much longer lived. The lower power consumption also enables the reduction of the size and cost of DC power supplies to provide emergency power. Accordingly, there are decided advantages to employing LEDs despite the objectionable point source appearance.

Recently, there have been efforts to utilize LED lamps as replacements in existing incandescent signs. These lamps have used one or two lamp bases which seat a circuit board with LEDs mounted thereon inside a glass tubular housing. With either the single or double board version, the lamps must be positioned in the socket so that the face of the board is substantially parallel to the stencil plate if maximum illumination of the stencil is to be obtained. Moreover, the light emitted is highly directional rather than diffuse.

It is an object of the present invention to provide a novel LED lamp for exit and emergency signs incorporating light emitting diodes as the light source which is not critical to its orientation relative to the stencil and which provides relatively diffuse illumination of the indicia of the sign legend.

It is also an object to provide such an LED lamp providing a substantially uniformly lighted appearance for the characters of the legend.

Another object is to provide such an LED lamp which can readily replace the incandescent and fluorescent light units in existing exit and emergency signs having single and double face stencil plates.

Yet another object is to provide such an LED lamp which can easily be manufactured with different types of lamp bases including candelabra screw, medium screw, intermediate screw, single or double contact bayonet, and the PL (bi-pin) base used with compact fluorescent lamps.

A further object is to provide such an LED lamp which may be fabricated readily and economically from components which may be readily assembled.

SUMMARY OF THE INVENTION

It has now been found that the foregoing and related objects may be readily attained in a LED lamp having a base which is configured to engage an associated electrical socket. The base has conductive elements on the outer surface thereof to effect a power connection to the socket and internal contacts coupled thereto.

Three elongated circuit boards extend from the other end of the base and are oriented with respect to each other to form an array of triangular cross section. Each of the circuit boards has a multiplicity of light emitting diodes mounted upon the outwardly disposed surface thereof and spaced along the length thereof. The circuit board also has conductor means connected to the diodes.

Power transfer means is provided for electrically connecting the conductor means of the circuit boards to the contacts in the base and to provide electrical power to the diodes. Mounted upon and extending from the other end of the base in spaced relationship to the diodes is a generally tubular housing of light transmitting material.

Desirably, there is included connector means for joining the circuit boards to hold them in the array, and this is effected by notches in the sides of the boards adjacent their ends, in which are seated connector means comprising circular wire clips. The power transfer means includes means for converting alternating current to direct current, and the means for converting alternating current includes an AC input capacitor and an AC to DC converter. Preferably, the AC input capacitor is a cylindrical film capacitor axially extending between the base and the adjacent end of the circuit boards.

Desirably, the base has apertures therein to allow air to pass therethrough into and from the interior of the generally tubular housing, and the circuit boards are of substantially equal dimension and the cross section of the array is an equilateral triangle.

An emergency sign utilizing the lamps includes a housing, at least one plate providing indicia thereon mounted in the housing, and at least one lamp socket in the housing behind the plate. The LED lamp is seated in the socket and illuminates the indicia plate.

Usually, the sign has two indicia bearing plates disposed on opposite sides of the housing and the socket and lamp are disposed therebetween.

DETAILED DESCRIPTION OF THE ILLUSTRATED EMBODIMENTS

Figure 1:
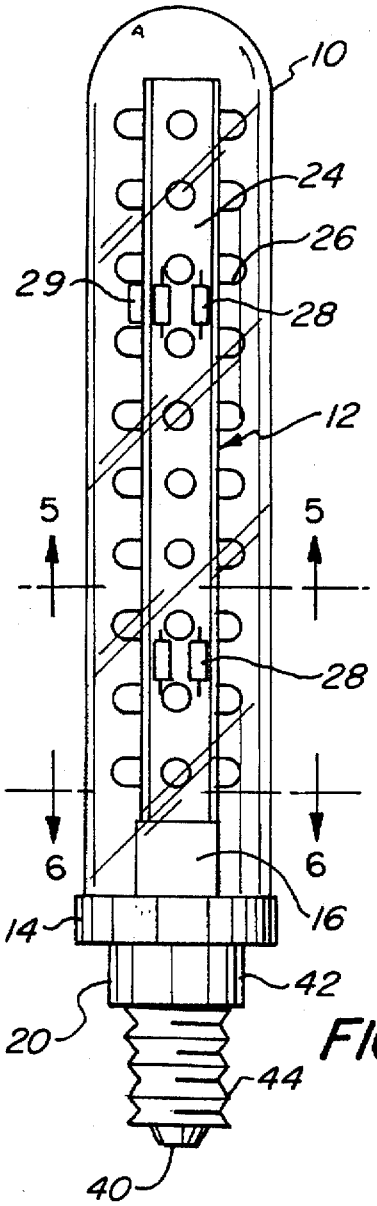
FIG. 1 is a side elevational view of an LED lamp embodying the present invention.

Turning first to the embodiment of FIGS. 1 and 4–7, therein illustrated is an elongated LED lamp embodying the present invention which is comprised of a generally tubular glass housing 10, a generally triangular light array generally designated by the numeral 12, an AC film capacitor 16, and a base designated by the numeral 20. This lamp is intended for use in an incandescent lamp socket.

The glass housing 10 is either clear or it may be frosted to diffuse the light. The end 11 of the housing 10 is semispherical and the other end 13 provides a circular opening. The glass housing 10 provides mechanical rigidity to the lamp assembly and protects the light array 12 from direct contact. If frosted, it will also diffuse the light passing therethrough.

The light array 12 comprises three elongated printed circuit boards 24 of equal length and width which are assembled in side-to-side relationship to provide a triangular cross section, equilateral triangular configuration. Each of the boards 24 includes a multiplicity of LEDs 26 in a rectilinear row, and the longitudinal axes of the rows of LEDs in the array are spaced apart 120°. Although the glass tube 10 helps disperse the light generated by the LEDs 26, the relatively uniform dispersion of light is mainly due to the novel triangular configuration of the light array 12.

The lamp base 20 includes a threaded, generally tubular metallic element 44 with a contact 40 at its lower end and an enlarged cup shaped collar portion 42 at its upper end. Seated in the collar portion 42 is the cylindrical base 34 on the mounting member generally designated by the numeral 14 which has a larger diameter cup shaped body portion 32 with axially extending passages 36 therethrough. The upper surface of the body portion 32 is configured to seat the lower end of the cylindrical AC film capacitor 16. Adhesive (not shown) may be used to bond the metallic element 42 and mounting member 14, and may also be used to bond the AC film capacitor 16 and the metallic element 44. The glass tube 10 seats snugly within the cup shaped body portion 32 and is adhesively bonded thereto.

Figure 4:
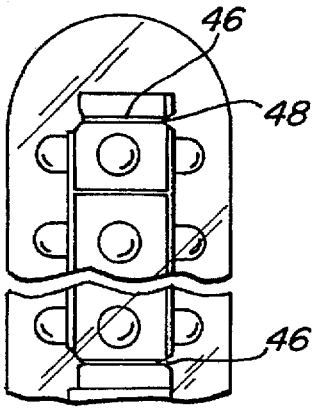
FIG. 4 is an enlarged fragmentary side elevational view of the LED lamp of FIG. 1.
Figures 5, 6, 7:
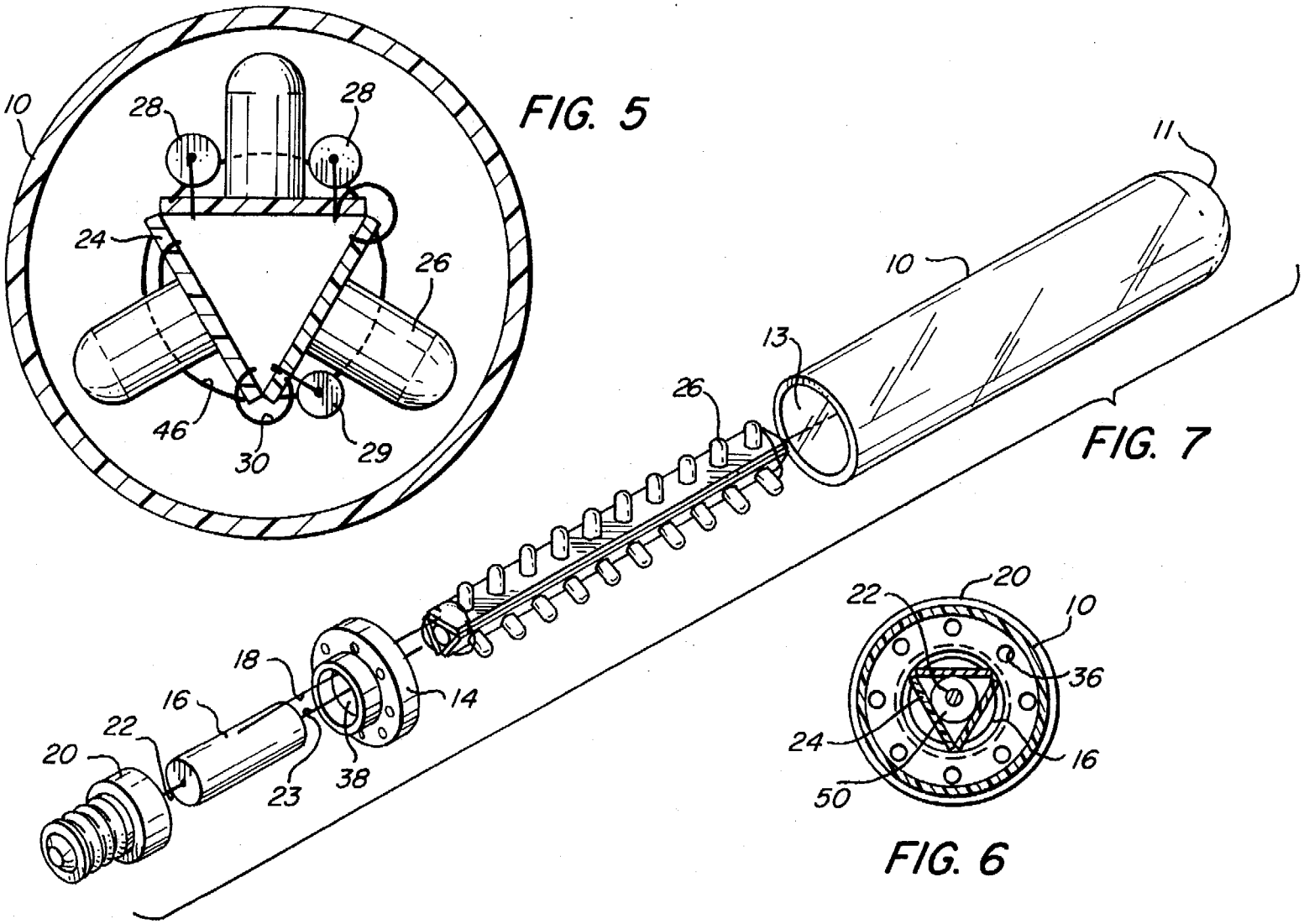
FIG. 5 is an enlarged cross sectional view of the LED lamp of FIG. 1 along the line 5—5.
FIG. 6 is an enlarged cross sectional view of the LED lamp of FIG. 1 along the line 6—6.
FIG. 7 is an exploded view of the LED lamp of FIG. 1.

As seen in FIGS. 4, 5 and 7, two wire clips 46 seat in special shaped notches 48 located adjacent the ends of the printed circuit boards 24 to assemble the boards 24 and provide mechanical rigidity.

As seen in FIG. 1, the electrical circuit assembly includes an input AC film capacitor 16, which together with diodes 28 and a resistor 29, as seen in FIG. 5, convert the input AC (alternating current) to DC (direct current) as required by LEDs 26 without any step-down transformer as in common practice. In addition, interconnecting circuit board leads 30 are soldered to the conductive paths on adjacent circuit boards 24 to provide an electrical connection between the individual circuit boards 24 of the light array 12.

The end of the light array assembly 12 nearest to the lamp base 20 abuts one end of the axial-lead AC film input capacitor 16. The capacitor 16 is a cylinder and a circular bushing 50 is seated within the triangular array 12 to facilitate the alignment of the longitudinal axis of the capacitor 16 and of the board array 12 as illustrated in FIG. 6.

The AC film capacitor 16 is seated within the base 20 and projects through the aperture 38 in the mounting member 14. The capacitor lead 22 is soldered to the contact 40 on the base 20 where it will be supplied AC power through a corresponding contact in a mating electrical socket (not shown). To complete the circuit, the return wire 18 is soldered to the inside conductive wall of the base 20.

A board lead 23 has one end soldered to the back of one of the circuit board strips 24 and another end soldered to the capacitor 16. The board lead 23 is passed through PVC tubing 52 (seen in FIG. 3) to provide isolation between it and the conductive circuit on the back of printed circuit boards 24.

The passages 36 allow air to circulate between the exterior and interior of the tube 10.

A candelabra screw type base 20 is illustrated in FIGS. 1 and 7. However, the base 20 can have different configurations and contacts including a concentrical, intermediate or medium screw, a bayonet single (not shown), or a double contact (bi-pin) base seen in FIGS. 2–3 designed to fit compact fluorescent lamp sockets.

Figure 2:
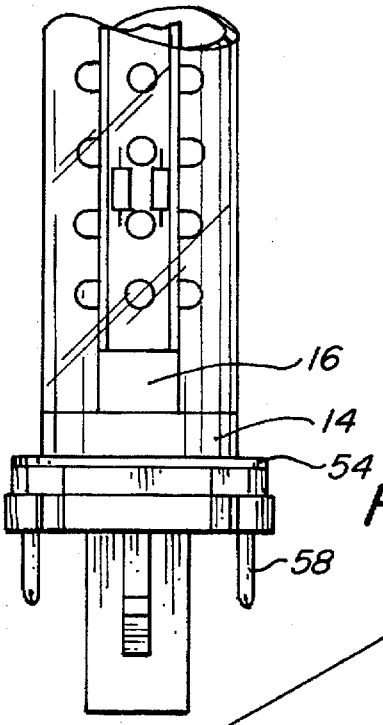
FIG. 2 is a fragmentary side elevational view of another embodiment of the LED lamp of the present invention using a PL (bi-pin) base adaptor.
Figure 3:
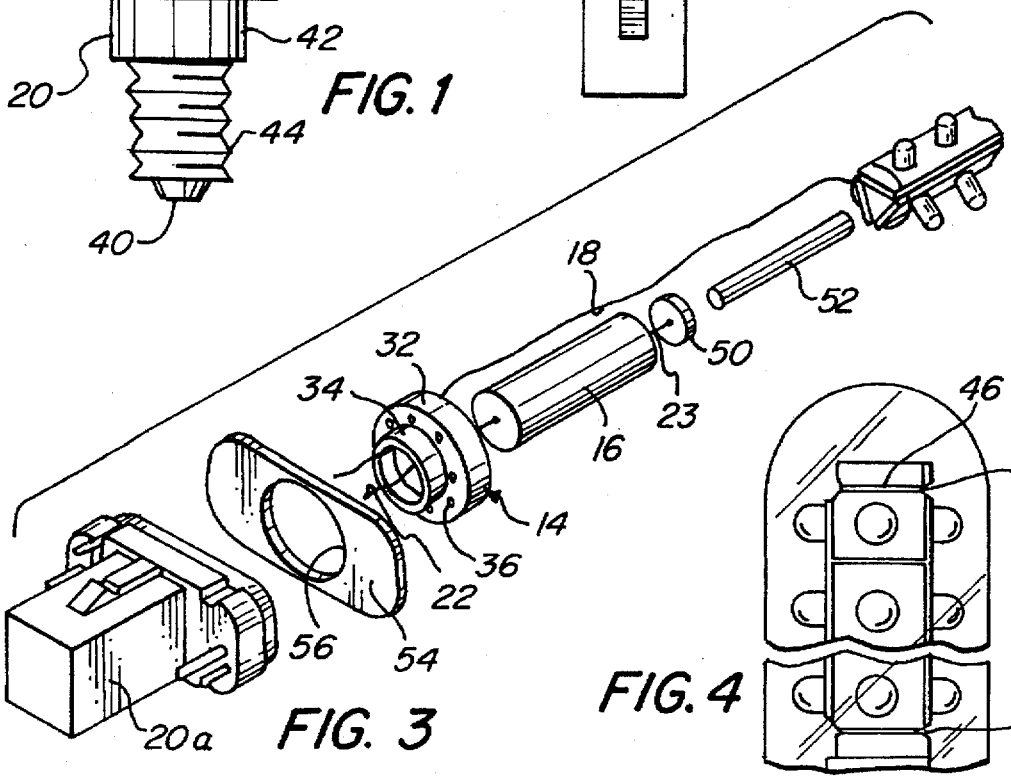
FIG. 3 is an exploded view of the LED lamp of the LED lamp of FIG. 2 exclusive of the tube.

In the embodiment of FIGS. 2–3, the base 20*a* has a cover 54 which provides an interface between the mounting member 14 and PL (bi-pin) base 20*a*. Both the capacitor lead 22 and the return wire 18 pass through the aperture 56 in the cover 54 and each is soldered to a separate pin 58 of the PL (bi-pin) base 20*a*. The base 34 of the mounting member 14 extends through the aperture 56 and seats in the base 20*a*. A thin layer of adhesive between the surface of the mounting member 14 and cover 54 and between the base 34 and the interior of the base 20*a* bonds these elements.

The advantages of an LED lamp include longer life and less power consumption than comparable incandescent and fluorescent lamps. In addition, unlike compact fluorescent lamps, the LEDs do not require special ballasts to match them to the recommended voltage and current rating. Thus, the LED lamp with PL (bi-pin) base adaptor 20*a* is a direct replacement for existing compact fluorescent lamps without any concern for the ballast rating and/or any need for wiring modifications.

The alternative PL (bi-pin) embodiment of the LED lamp is adapted to be inserted into the housing of existing lighted sign assemblies as a direct replacement light unit for the fluorescent lamps of the original equipment. The major advantage is that the LED lamp is able to replace the existing compact adaptor without any need to remove the installed ballasts and/or any modifications done to the internal wiring of the already installed signs.

Figure 8:
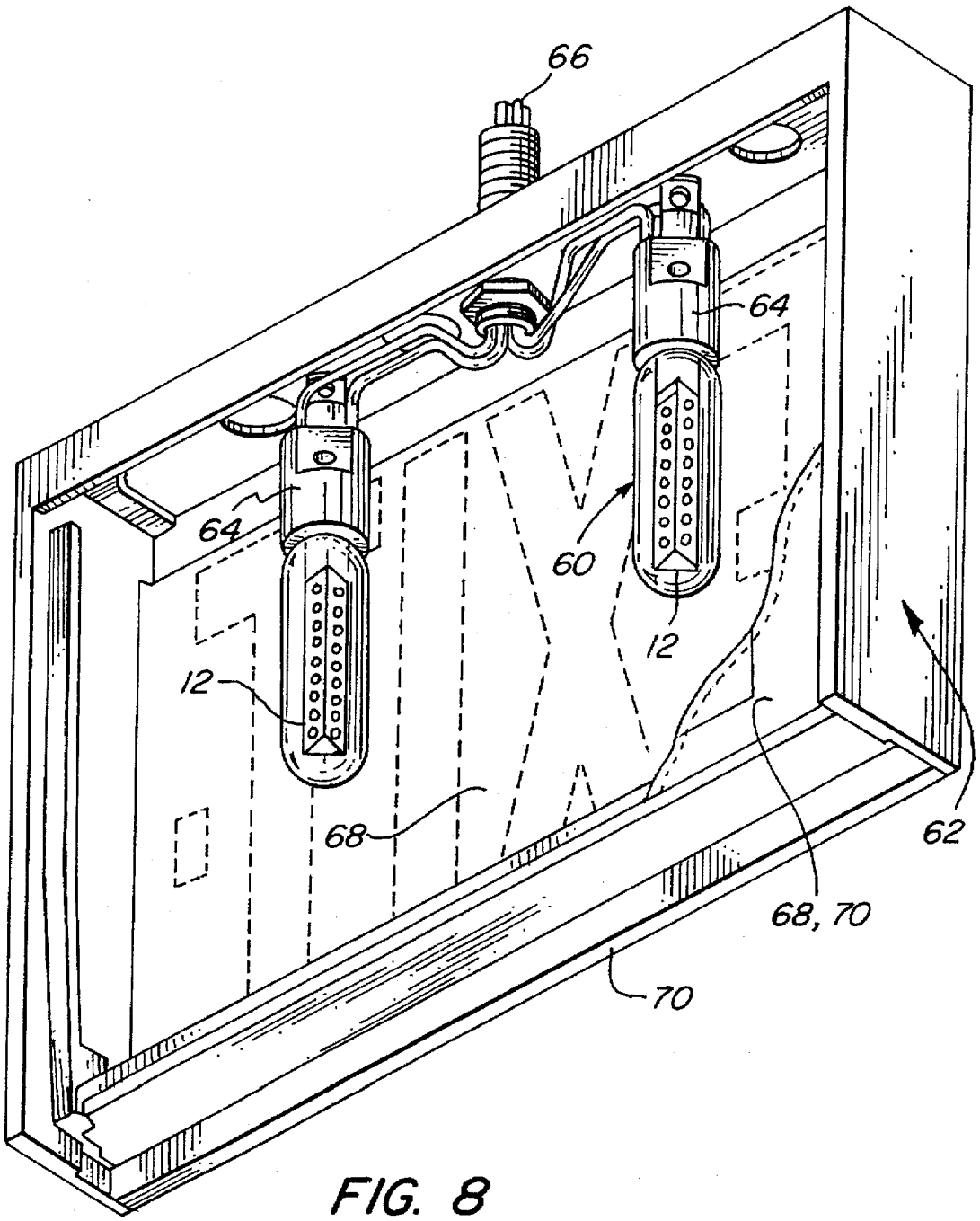
FIG. 8 is a fragmentary view in partial sections of an emergency exit sign containing lamps embodying the present invention.

Turning next to FIG. 8, therein fragmentarily illustrated is an exit sign utilizing the LED lamps embodying the present invention and generally designated by the numeral 60. The exit sign includes two lettered stencils 68 and glass faceplates 70 mounted on either side of the exit sign housing 62. Two LED lamps 60 are spaced within the housing 62 and seated within electrical sockets 64, which are in turn connected by wiring 66 to an outside power source to energize the light array 12.

Figure 9:
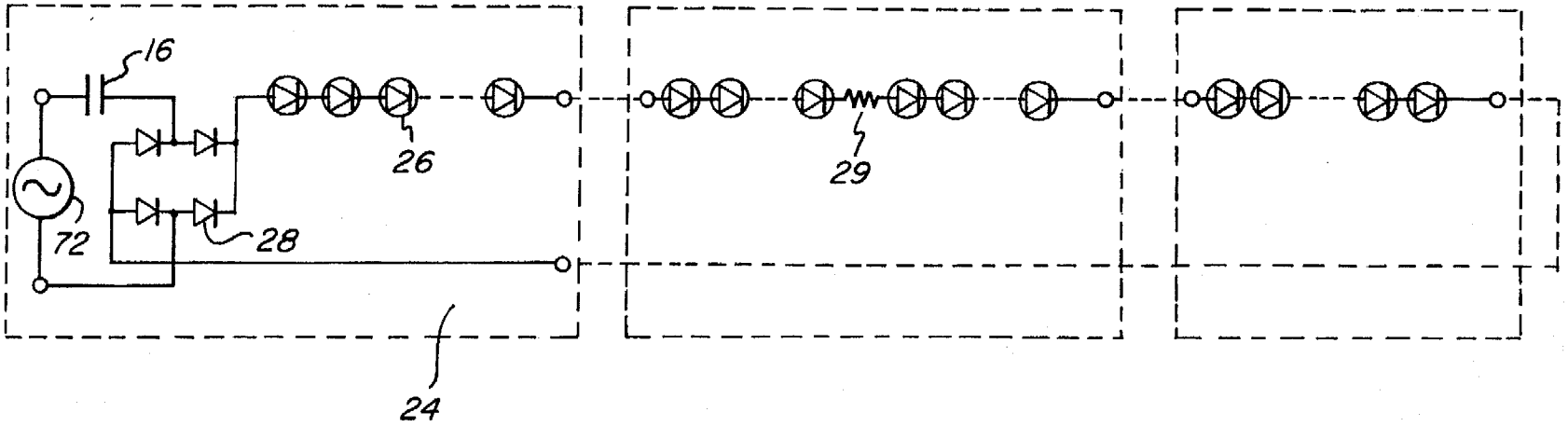
FIG. 9 is a circuit diagram of the LED lamp of FIG. 1.

Turning next to FIG. 9, therein schematically illustrated is the circuitry of the LED lamp of FIG. 1. The voltage of the AC power source 72 is reduced by the film capacitor 16, and then rectified by the diodes 28 into DC current. This DC current is then limited by the resistor 29 which is connected in series to each circuit board 24 to power the LEDs 26.

Due to the highly directional nature of LEDs, a single board LED lamp cannot evenly illuminate a two faced exit sign 62. As a result, a single board LED lamp cannot be used effectively in a double faced exit sign. Although a double board LED lamp is more effective than a single board LED lamp in a double faced exit sign, the LED boards must still be carefully oriented parallel to the faces of the exit sign in order to effectively illuminate the two faces of the exit sign. This will likely cause an installer to either mount the double board LED either too loosely in the socket thereby degrading the electrical connection or too tightly in the socket thereby over torquing the lamp. In contrast to the single or double board LED lamps, the novel triangular array of the circuit boards 24 and their corresponding LEDs 26 create a non-directional light source, the orientation of light array 12 is inconsequential.

Thus, it can be seen from the foregoing detailed description and the attached drawings that the LED lamps of the present invention provide relatively uniform illumination of the indicia of the sign legend plate and do not require any special rotated orientation relative to the plane of the plate since the light rays are emanating about the entire circumference of the lamp. Moreover, the LED lamp can easily be manufactured with different types of lamp bases, including candelabra screw, medium screw, intermediate screw, bayonet single or double contact base, and the PL (bi-pin) base used with compact fluorescent lamps.

Having thus described the invention, what is claimed is:

1. LED lamp comprising:

(a) a base having one end configured to seat in an associated electrical socket, said base having an outer surface with conductive elements thereon to effect a power connection to the socket and house current, said base also having internal contacts therein coupled to said conductive elements;

(b) three elongated circuit boards extending from the other end of said base and oriented with respect to each other to form an array of generally equilateral triangular cross section, each of said circuit boards having a multiplicity of light emitting diodes mounted upon the outwardly disposed surface thereof disposed away from the other circuit boards and spaced along substantially the entire length thereof, and conductor means connected to said diodes, said circuit boards defining a triangular cavity therebetween;

(c) power transfer means disposed substantially within said base and in said cavity for electrically connecting said conductor means of said circuit boards to said contacts to effect modification of house current and to provide electrical power to said diodes; and (d) a generally tubular housing of light transmitting material mounted upon and extending from said other end of said base in spaced relationship about said diodes, whereby said light emitting diodes are disposed over most of the length of said tubular housing to provide substantially uniform illumination over the length thereof.

2. The lamp in accordance with claim 1 wherein there is included connector means for joining said circuit boards to hold said boards in said triangular array.

3. The lamp in accordance with claim 2 wherein said boards have notches in the side edges thereof adjacent the ends thereof, and said connector means comprise circular wire clips seated in said notches.

4. The lamp in accordance with claim 1 wherein said power transfer means includes means for converting alternating current to direct current.

5. The lamp in accordance with claim 4 wherein said means for converting alternating current includes an AC input capacitor and an AC to DC converter.

6. The lamp in accordance with claim 5 wherein said AC input capacitor is a cylindrical film capacitor oriented with its axis extending between said base and the end of said circuit boards adjacent thereto.

7. The lamp in accordance with claim 1 wherein said base has apertures therein to allow air to pass therethrough into and outwardly of said generally tubular housing.

8. The lamp in accordance with claim 1 wherein said circuit boards are of substantially equal dimension and said cross section of the array is an equilateral triangle.

9. In an emergency sign, the combination comprising:

(a) a housing;

(b) at least one plate mounted in said housing and providing indicia across the face thereof;

(c) at least one lamp socket in said housing behind said plate; and (d) an LED lamp comprising:

(i) a base having one end engaged in said electrical socket said base having an outer surface with conductive elements thereon effecting a power connection with said socket and house current, said base also having internal contacts therein coupled to said conductive elements;

(ii) three elongated circuit boards extending from the other end of said base and oriented with respect to each other to form an array of generally equilateral triangular cross section, each of said circuit boards having a multiplicity of light emitting diodes mounted upon the surface thereof disposed away from the other circuit boards and spaced along substantially the entire length thereof and conductor means connected to said diodes said circuit, boards defining a triangular cavity therebetween;

(iii) power transfer means disposed substantially within said base and in said cavity for electrically connecting said conductor means of said circuit boards to said contacts to effect modification of house current and to provide electrical power to said diodes; and (iv) a generally tubular housing of light transmitting material mounted upon and extending from said other end of said base in spaced relationship about said diodes; whereby said light emitting diodes are disposed over most of the length of said tubular housing to provide substantially uniform illumination over the length thereof.

10. The sign in accordance with claim 9 wherein there are two indicia bearing plates disposed on opposite sides of said housing and said socket and lamp are disposed therebetween.

11. The sign in accordance with claim 10 wherein there is included connector means for joining said circuit boards to hold said boards in said triangular array, and wherein said boards have notches in the side edges thereof adjacent the ends thereof, and said connector means comprise circular wire clips seated in said notches.

12. The sign in accordance with claim 9 wherein said power transfer means includes means for converting alternating current to direct current.

13. The sign in accordance with claim 12 wherein said means for converting alternating current includes an AC input capacitor and an AC to DC converter.

14. The sign in accordance with claim 13 wherein said AC input capacitor is a cylindrical film capacitor with its axis extending between said base and the end of said circuit boards adjacent thereto.

15. The sign in accordance with claim 9 wherein said base has apertures therein to allow air to pass therethrough into and outwardly of said generally tubular housing.

16. An LED lamp comprising:

(a) a base having one end configured to seat in an associated electrical socket, said base having an outer surface with conductive elements thereon to effect a power connection to the socket and house current, said base also having internal contacts therein coupled to said conductive elements;

(b) three elongated circuit boards extending from the other end of said base and oriented with respect to each other to form an array of generally equilateral triangular cross section, each of said circuit boards having a multiplicity of light emitting diodes mounted upon the surface thereof disposed away from the other circuit boards and spaced along substantially the entire length thereof, and conductor means connected to said diodes, said circuit boards defining a triangular cavity therebetween;

(c) connector means for joining said circuit boards to hold said circuit boards in said triangular array, said boards having notches in the side edges thereof adjacent the ends thereof, said connector means comprising wire clips seated in said notches;

(d) power transfer means for electrically connecting said conductor means of said circuit boards to said contacts to effect modification of house current and to provide electrical power to said diodes; and (e) a generally tubular housing of light transmitting material mounted upon and extending from said other end of said base in spaced relationship about said diodes, whereby said light emitting diodes are disposed over most of the length of said tubular housing to provide substantially uniform illumination over the length thereof.

17. An LED lamp comprising:

(a) a base having one end configured to seat in an associated electrical socket, said base having an outer surface with conductive elements thereon to effect a power connection to the socket and house current, said base also having internal contacts therein coupled to said conductive elements;

(b) three elongated circuit boards extending from the other end of said base and oriented with respect to each other to form an array of generally equilateral triangular cross section, each of said circuit boards having a multiplicity of light emitting diodes mounted upon the surface thereof disposed away from the other circuit boards and spaced along substantially the entire length thereof, and conductor means connected to said diodes, said circuit boards defining a triangular cavity therebetween;

(c) connector means for joining said circuit boards to hold said circuit boards in said triangular array, said boards having notches in the side edges thereof adjacent the ends thereof, said connector means comprising circular wire clips seated in said notches;

(d) power transfer means for electrically connecting said conductor means of said circuit boards to said contacts to effect modification of house current and to provide electrical power to said diodes, said transfer means including means for converting alternating current to direct current and comprising an AC input capacitor and an AC to DC converter, said input capacitor comprising a cylindrical thin film capacitor oriented with its axis extending between said base and the adjacent end of said circuit boards; and (e) a generally tubular housing of light transmitting material mounted upon and extending from said other end of said base in spaced relationship about said diodes, whereby said light emitting diodes are disposed over most of the length of said tubular housing to provide substantially uniform illumination over the length thereof.

* * * * *